US008807153B2

(12) United States Patent
Dalo

(10) Patent No.: US 8,807,153 B2
(45) Date of Patent: Aug. 19, 2014

(54) SUPPORT UNIT OF A ROOF ELEMENT AND LIGHTWEIGHT SHELTER COMPRISING SUCH SUPPORT UNIT

(76) Inventor: Catherine Dalo, Saint Martin de Nigelles (FR)

( * ) Notice: Subject to any disclaimer, the term of this patent is extended or adjusted under 35 U.S.C. 154(b) by 0 days.

(21) Appl. No.: 13/072,310

(22) Filed: Mar. 25, 2011

(65) Prior Publication Data

US 2011/0259382 A1 Oct. 27, 2011

(30) Foreign Application Priority Data

Mar. 26, 2010 (FR) ..... 10 01237

(51) Int. Cl.
*E04H 15/26* (2006.01)
*E04H 15/28* (2006.01)

(52) U.S. Cl.
USPC ..... 135/98; 135/99

(58) Field of Classification Search
USPC ..... 135/98, 99, 21, 28, 38–40, 120.3, 120.4
See application file for complete search history.

(56) References Cited

U.S. PATENT DOCUMENTS

| | | | | | |
|---|---|---|---|---|---|
| 300,993 | A | * | 6/1884 | Marvin | 135/98 |
| 534,058 | A | * | 2/1895 | Ackermann et al. | 135/98 |
| 1,543,134 | A | * | 6/1925 | Libanus | 52/13 |
| 1,912,564 | A | * | 6/1933 | Benson et al. | 135/98 |
| 2,143,978 | A | * | 1/1939 | Eeles | 135/25.3 |
| 2,483,585 | A | * | 10/1949 | Lewis | 211/197 |
| 2,692,566 | A | * | 10/1954 | Mitchell | 52/63 |
| 3,090,162 | A | * | 5/1963 | Baroni | 52/80.2 |
| 3,521,416 | A | * | 7/1970 | Joor | 52/222 |
| 3,870,062 | A | * | 3/1975 | Medlin | 135/20.3 |
| 3,945,106 | A | * | 3/1976 | Mayr et al. | 29/429 |
| 4,677,796 | A | * | 7/1987 | Mellott | 52/73 |
| 5,564,453 | A | * | 10/1996 | Steiner | 135/98 |
| 5,740,822 | A | * | 4/1998 | Einck | 135/16 |

(Continued)

FOREIGN PATENT DOCUMENTS

| | | | |
|---|---|---|---|
| DE | 1434570 | A1 | 10/1969 |
| EP | 0277073 | B1 | 6/1992 |
| EP | 1905926 | A1 | 4/2008 |
| EP | 1932983 | A1 | 6/2008 |
| FR | 2684712 | A1 | 6/1993 |

OTHER PUBLICATIONS

Preliminary Search Report of FR 10/01237; Jan. 14, 2011; Delzor Francois.

(Continued)

*Primary Examiner* — Noah Chandler Hawk
(74) *Attorney, Agent, or Firm* — BCF LLP

(57) ABSTRACT

This invention relates to a support unit of a roof element comprising a frame and a fabric fixed on the frame and intended to be stretched between said frame and the support unit, said support unit comprising a central mast and being remarkable in that it comprises means of connecting assembled slidingly and in a lockable manner on said central mast and arranged in order to be fixed to the fabric, a plurality of cables fixed on the upper end of the central mast. This invention also has for object a lightweight shelter comprising a support unit according to the invention, a frame and a fabric, and a modular awning comprising a plurality of lightweight shelters. This invention relates finally to the methods for assembling said lightweight shelter and modular awning.

23 Claims, 5 Drawing Sheets

(56) References Cited

U.S. PATENT DOCUMENTS

| | | | | |
|---|---|---|---|---|
| 6,766,814 | B2 * | 7/2004 | Perreault | 135/31 |
| 7,395,830 | B2 * | 7/2008 | Seo | 135/140 |
| 7,563,000 | B2 * | 7/2009 | Gierveld | 362/249.01 |
| 7,909,051 | B2 * | 3/2011 | Victory et al. | 135/98 |
| 2005/0178616 | A1 * | 8/2005 | Bouchard | 182/129 |
| 2009/0199886 | A1 * | 8/2009 | Dalo | 135/123 |

OTHER PUBLICATIONS

English abstract of EP 1932983.
English abstract of EP 1905926.
English abstract of FR 2684712.
English abstract of EP 0277073 retrieved from Espacenet on Mar. 27, 2013.

* cited by examiner

Fig. 1
PRIOR ART
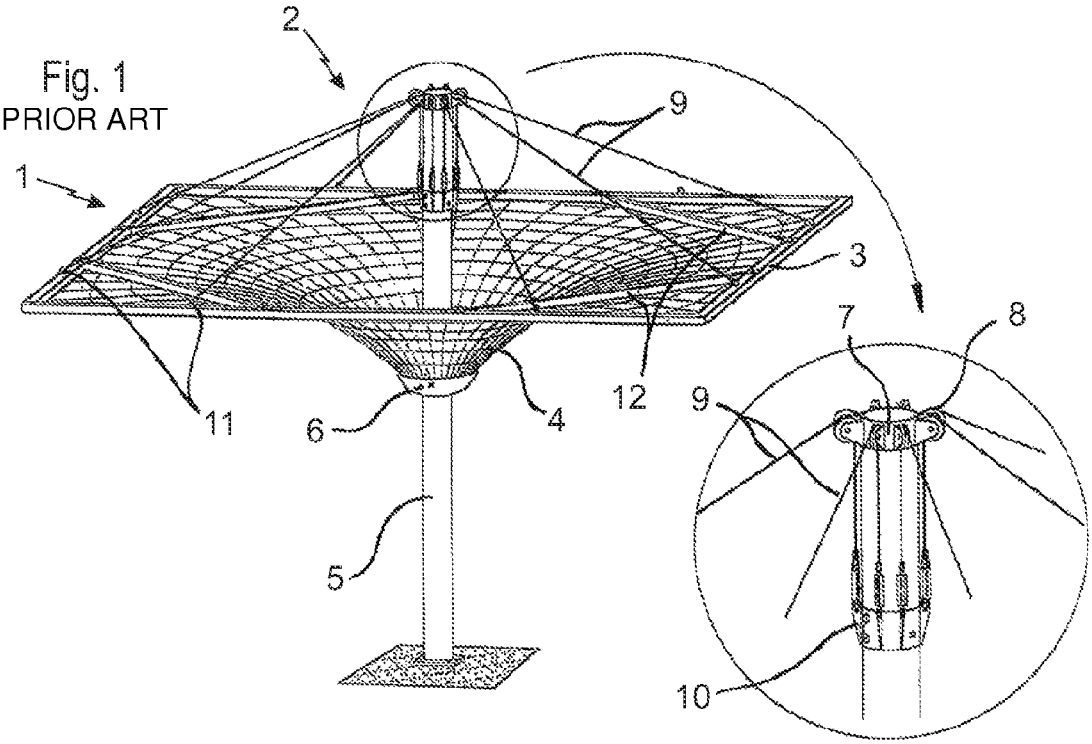
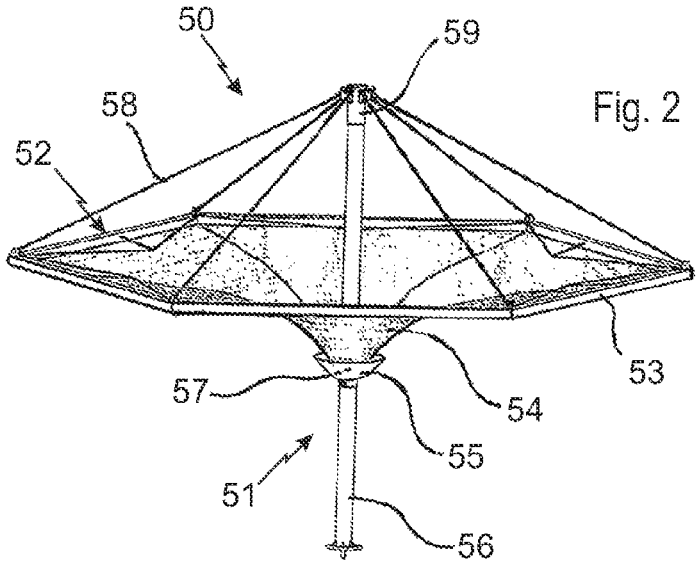
Fig. 2

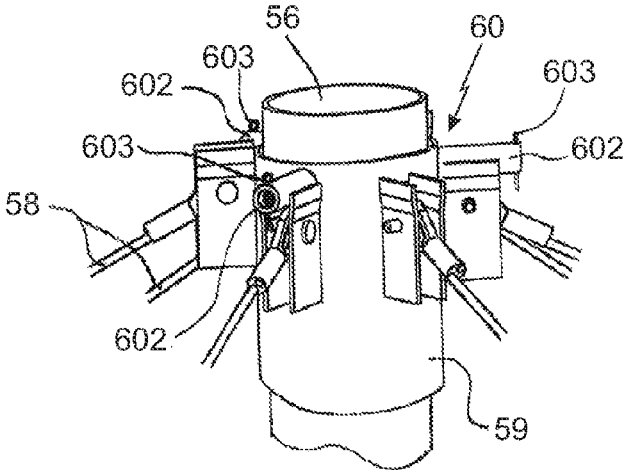
Fig. 6
Fig. 7
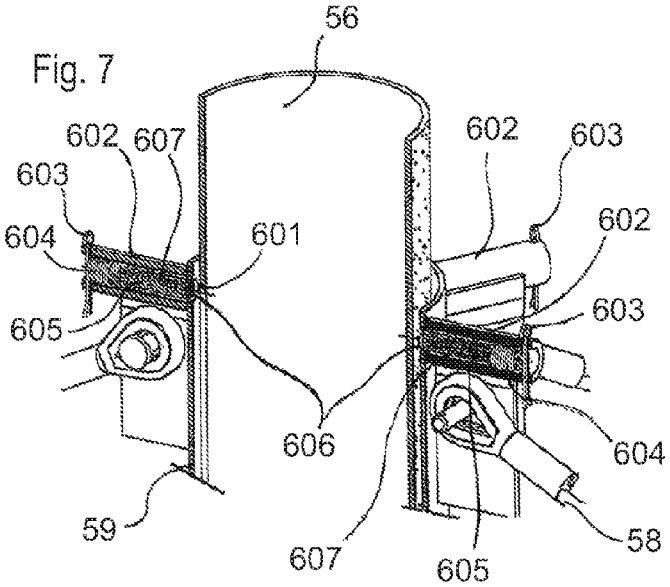
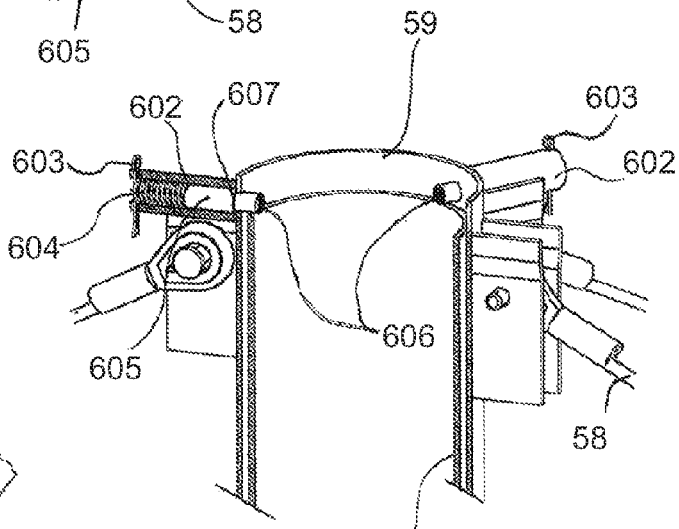
Fig. 8
Fig. 9
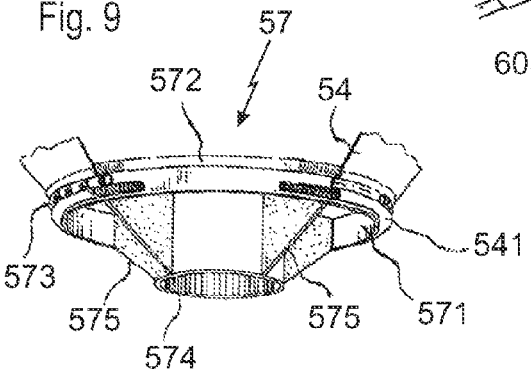

Fig. 11
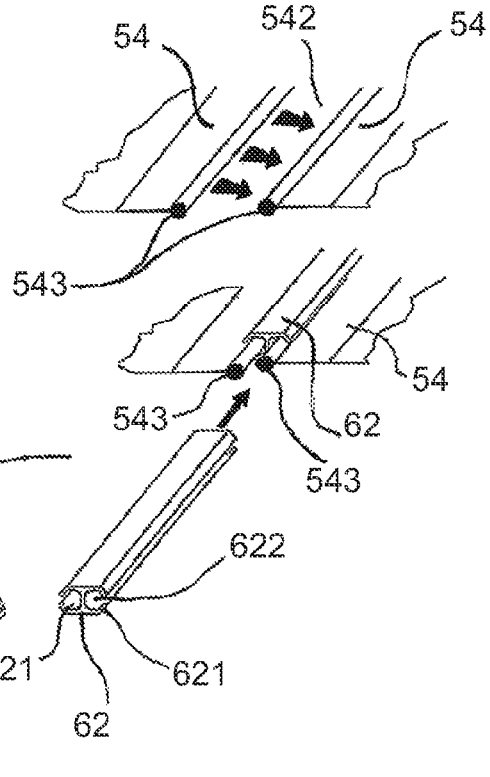
Fig. 10
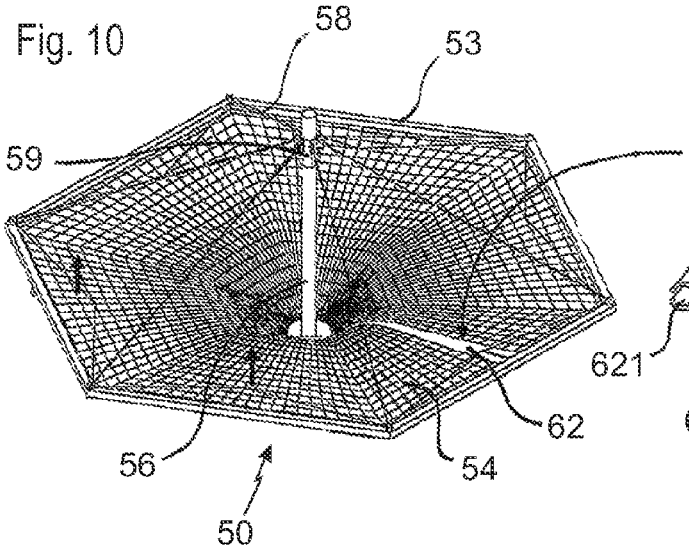
Fig. 12
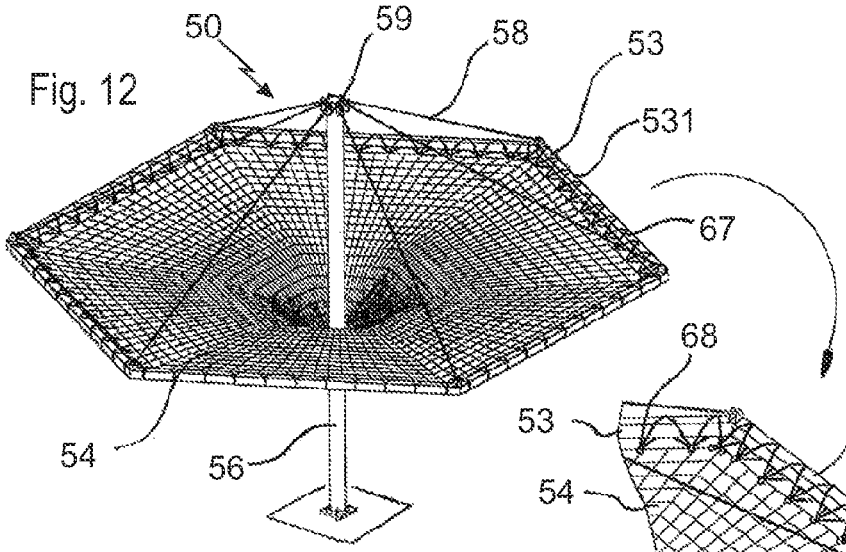
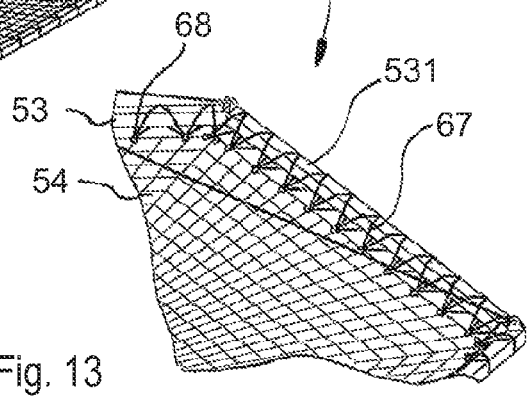
Fig. 13

SUPPORT UNIT OF A ROOF ELEMENT AND LIGHTWEIGHT SHELTER COMPRISING SUCH SUPPORT UNIT

TECHNICAL FIELD

This invention relates to a support unit of a roof element comprising a frame and a fabric intended to be stretched between the frame and the support unit, a lightweight shelter comprising such a support unit, a modular awning constituted of a plurality of lightweight, shelters. This invention further relates to the respective methods of assembly of the lightweight shelter and modular awning.

PRIOR ART

In the field of this type of shelter, a shelter of the central mast type is already known such as that described in European patent application EP 1 932 983 filed in the name of the applicant. This shelter 1, according to prior art, is shown in FIG. 1 and comprises a support unit 2 a roof element comprising a frame 3 in the form of a guadrilateral and a fabric 4 fixed by its external peripheral portion on the frame 3 and intended to be stretched between said frame 3 and the support unit 2.

Said support unit 2 comprises a central mast 5, a segment 6 assembled slidingly, able to be locked on said central mast 5 and arranged in order to receive the central portion of said fabric 4, a flange 7 fixed. on the upper portion of said central mast 5, said flange 7 comprising a unit of radial pulleys 8 each able to receive a cable 9, and a tension ring 10 assembled slidingly and able to be locked on said central mast 5.

Each cable 9 passes on one of the pulleys 8 and a first end fixed to the tension ring 10 and a second end fixed to the frame 3, said tension ring 10 of the support unit 2 being locked on the central mast 5 in a position such that the cables 9 are stretched.

The assembly of this shelter takes place in the following way. The support unit 2, comprising the central mast 5, the segment. 6, the flange 7, the tension ring 10 and the cables 9, is erected. The frame 3 is then arranged or assembled around said support unit 2. The second end of each cable 9 of the support unit 2 is then fixed to fastening points 11 provided on the frame 3. The fabric 4 is fixed on the frame 3 by its external periphery and on the segment 6 by its internal periphery defined by its central portion. The tension ring 10 is drawn downwards in order, on the one hand, to raise the frame 3 and, on the other hand, to stretch the fabric 4 by pushing the segment 6 downwards. Finally, once the desired stretching of the fabric is obtained, the tension ring 10 is locked on the central mast 5 in the desired final position.

The support unit 2 according to prior art has a certain number of disadvantages. Indeed, due to its high number of constituting elements and their complexity, this support unit 2 is particularly difficult and costly to carry out and implement.

Moreover, during the fastening of the second end of each cable 9 of the support unit 2 on the frame 3 to fastening points 11, if said cable 9 escapes and the latter becomes disengaged from its pulley 8 and falls to the ground, a ladder or scaffolding must then be used to again engage the cable 9 in its pulley 8 and fix it on the frame 3, as the pulleys 8 are integral with the flange 7 fixed on the upper portion of said central mast 5. This manipulation must be carried out with much attention in order to avoid an increase in the assembly cost due to the increase in the assembly hours and the use of additional equipment.

Moreover, for frames 3 of large dimensions, the cables 9 must be connected to several fastening points 11 distributed along each of the sides of the frames 3 but also to the tops of said frames 3 otherwise the frame can become deformed. The cables 9 connected to the tops generate, in light of the overhang, mechanical stresses such that it is necessary to substantially increase the section of said frames 3 and to set up reinforcements 12 in order to counter the mechanical loads. Finally, this configuration requires having cables 9 of different length. Consequently, the production cost of this type of shelter 1 is high as the sections of the frame 3 are substantial and such a configuration does not allow for a uniformizing of the elements that comprise said support unit 2.

DESCRIPTION OF THE INVENTION

The object of this invention is therefore to overcome the aforementioned disadvantages and to propose an alternative solution for a support unit of a roof element and of a lightweight shelter of the central mast type comprising such a support unit of which the structures are substantially lighter therefore more economical and as such that their assembly is advantageously easier due to the fact in particular of the reduced number of different parts.

In accordance with the invention, it is therefore proposed a support unit of a roof element of a lightweight shelter comprising a central mast, the roof element comprising a frame, a fabric fixed by its exterior peripheral edge on the frame and intended to be stretched between said frame and the support unit, and means of connecting arranged in order to receive the central portion of said fabric, remarkable in that it comprises:

- a flange assembled slidingly on said central mast and arranged in order to be locked at the upper end of the central mast by means of quick locking of the snap-fitting type and
- a plurality of cables of which one of the ends is fixed on said flange, the other being intended to be fixed on the frame, and in that said means of connecting are assembled. slidingly on said central mast and are arranged to be locked on said central mast.

This invention also has for object a lightweight shelter of the central mast type, remarkable in that it comprises:

- a support unit according to the invention;
- a frame arranged around the central mast of said support unit, having the shape of a regular polygon, and being suspended by the cables of the support unit connected solely to the fastening points of the frame arranged to the right of each top of the frame;
- a fabric provided in its central portion with an orifice of which the edge defines the interior peripheral edge of said fixed by its exterior peripheral edge on the frame and by its interior peripheral edge-on the means of connecting of the support unit, and intended to be stretched between said frame and the support unit;

said frame and fabric constituting a roof element.

According to a preferred embodiment, the frame is constituted of spars assembled to one another by their ends and it has the shape of a regular polygon comprising an even number of tops with a minimum equal to six.

According to another preferred embodiment, the spars each comprise a means of pre-stressing.

This invention further relates to a modular awning remarkable in that it comprises a plurality of lightweight shelters, according to the invention, arranged next to one another and a system for sealing between the spars across from the frames of two adjacent lightweight shelters.

The lightweight shelters according to the invention are arranged in such a way that they make it possible to obtain a modular awning of varied shapes and dimensions.

SUMMARY DESCRIPTION OF THE FIGURES

Other advantages and characteristics shall become clearer in the following description of an alternative embodiment of a support unit of a roof element, of a lightweight shelter of the central mast type comprising such a support unit according to the invention and of a modular awning in reference to the annexed figures wherein:

FIG. 1 is a perspective view of a lightweight shelter comprising a support unit of a roof element according to prior art;

FIG. 2 is a perspective view of a lightweight shelter comprising a support unit of a roof element according to the invention;

FIGS. 6 to 8 are partial or non-partial perspective views of a flange of a lightweight shelter according to the invention in the process of being placed at the top of the central mast, at different stages of said putting into place;

FIG. 9 is a perspective view of the means of connecting of the support unit of a roof element of a lightweight shelter according to the invention;

FIG. 10 is a perspective view of a lightweight shelter according to the invention comprising a fabric provided with a connecting member;

FIG. 11 is a series of detailed perspective views of the connecting member of the preceding figure in the process of being assembled on the fabric;

FIG. 12 is a perspective view of an alternative embodiment of a lightweight shelter according to the invention;

FIG. 13 is a detailed view of the alternative embodiment of the lightweight shelter according to the preceding figure;

BEST MANNER FOR CARRYING OUT THE TECHNICAL INVENTION

Figure 3:
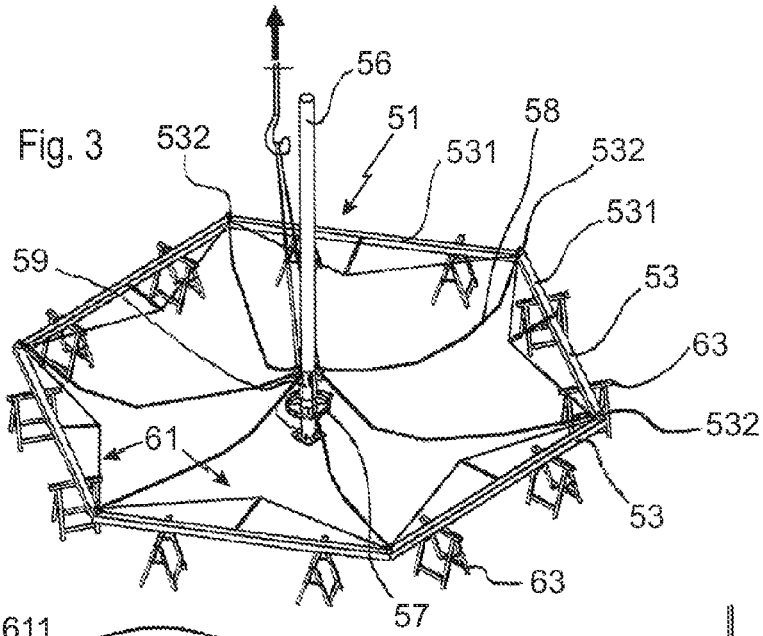
FIGS. 3 to 5 are perspective views of a lightweight shelter according to the invention in the process of being assembled on the ground, at different stages of said assembly.
Figure 3:
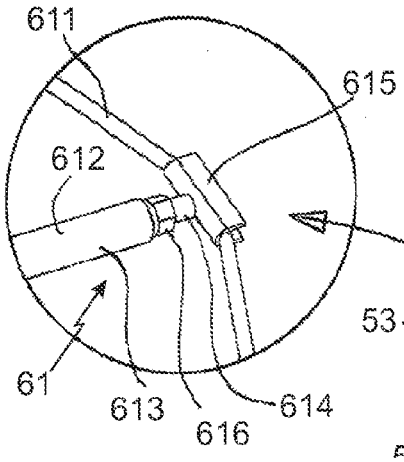

FIG. 2 shows a lightweight shelter 50 comprising a support unit 51, a roof element 52 comprising a frame 53 in the shape of a polygon and a fabric 54 fixed by its exterior peripheral edge on the frame 53 and intended to be stretched between said frame 53 and the support unit 51, said fabric 54 is provided in its central portion with an orifice of which the edge defines the interior peripheral edge of the fabric 54. This lightweight shelter 50 further comprises a rain water collector 55.

In accordance with the invention, said element support 51 comprises a central mast 56, means of connecting 57 (see FIG. 9) assembled slidingly on said central mast 56 and arranged in order to be locked on said central mast 56, and a plurality of cables 58 of which one of the ends is fixed on the upper end of said central mast 56, the other being intended to be fixed on the frame 53. As such, it is understood that this support element 51 comprises few parts and is consequently easy and quick to implement.

For reasons relating to the facility of assembly (described further on), the support element 51 advantageously comprises a flange 59 assembled slidingly on said central mast 56 and arranged in order to be fixed to the upper end of said central mast 56 and to receive the end of the cables 58. The central mast 56 is intended to be fixed on a solid body (not shown) by means of fastening (not shown) such as sealing crossheads or any other analogous means procuring the same effects such as chemical or self-expanding anchorings for example.

Moreover, the central mast 56 is more preferably a hollow tube connected at the lower portion to a device for evacuating rainwater (not shown). In addition, this central mast 56 comprises an orifice (not shown) able to cooperate with the rain water collector 55 in order to evacuate towards said device for evacuating rainwater received on the fabric 54 of the roof element 52.

The means of connecting are furthermore arranged in order to receive the interior peripheral edge of the fabric 54. For this, these means of connecting 57 are analogous to the means of connecting described in European patent application EP 1 905 926 filed in the name of the applicant.

As such, in reference with FIG. 9, the fabric 54 comprises along its interior peripheral edge a ring 541, i.e. a bead. This ring 541 is formed by a ring taken in a fold of said fabric 54, said ring being for example made from natural or synthetic cord.

The means of connecting 57 comprises a segment 571, i.e. an annular portion, intended to receive on its exterior face the ring 541 of the fabric 54. This segment 571 is provided at its upper end with a stop 572 extending radially towards the exterior, fixed to the segment 571 for example by welding, and a locking ring 573 which, in the position where the fabric 54 is assembled, is interposed between the ring 541 and the stop 573 as such providing the blocking of the ring 541.

Moreover, the means of connecting 57 further comprise a sleeve 574 preferably cylindrical allowing for the sliding of said means of connecting 57 along the central mast 56 and means of connecting 575 connecting the sleeve 574 to the segment 571, these means of connecting 575 being, for example, in the form of a plurality of radial wings.

In order to facilitate setting it in place on the central mast 56, in reference to FIGS. 6 to 8, the flange 59, which is more preferably a tubular element of the sleeve type assembled slidingly on the central mast. 56, comprises means of (quick locking 60. The latter are advantageously of the snap-fitting type and include at least one radial orifice 601 located on the tubular element of the flange 59, at least one advantageously cylindrical tubular housing 602 integral with the flange 59 and extending radially towards the exterior of the flange 59 to the right of the orifice 601, a stop 603 located at the free end of said housing 602, a thrust member 604 more preferably of the coiled spring type contained in the housing 602 and pressing against the stop 603, and a mobile element 605 passing partially through the orifice 601 and arranged in order to be displaced in the housing 602 under the action of the thrust member 604 from a "sliding position" (see FIGS. 6 and 7) wherein its end 606 is pressing against the exterior face of the central mast 56 to a "locking position" (see FIG. 8) wherein its end 606 is located inside the exterior face of the central mast 56.

Here, "the interior of the exterior face of the central mast 56" designates the position wherein the end 606 of the mobile element 605 has actually or as a projection passed through the exterior face of the central mast 56 in the direction of the interior of said central mast 56.

In order to limit its travel inside the housing 602, the mobile element 605, which is more preferably a cylinder, is provided with a stop 607 being advantageously of the type of a shoulder coming to press against the exterior face of the flange 59.

With this configuration of the means of quick locking 60, in the "sliding position", the flange 59 can slide along the central mast 56 and, in the "locking position", the flange is blocked at the upper end of said central mast 56.

Advantageously, in the "locking position" the mobile element 605 comes to press against the annular face of the upper end of the central mast 56 (see FIG. 8). This "locking position" is perfectly secure as, on the one hand, the flange 59 has a length that is sufficient in order to prevent it from disengaging from the end of the central mast 56 and, on the other hand, the cables 58 of the support unit 51 will exert on said flange 59 a traction force downwards in such a way as to maintain the mobile element 605 pressing against the annular face of the upper end of the central mast 56 and therefore maintain the flange 59 locked on said central mast 56.

In a preferred embodiment, the means of quick locking 60 comprise, three orifices 601 arranged in the same radial plane on the flange 59 and of which the axes form an angle of 120° between them, and three "housing 602-stop 603-thrust member 604-mobile element 605" units.

In accordance with the invention, the lightweight shelter 50 further comprises a roof element. 52 comprising a frame 53 arranged around the central mast 56 of the support unit 51, constituted of spars 531 assembled to one another, having the global shape of a regular polygon and being suspended by the cables 58 of the support unit 51 connected solely to each of the tops of said frame 53 in order to limit the overhang. For reasons of mechanical equilibrium, the frame 53 will advantageously have an even number of tops with a minimum equal to six.

In a preferred embodiment, the frame 53 has the shape of a regular hexagon.

Therefore, all of the cables 58 are of identical length as such limiting the number of different parts to be supplied in order to carry out said lightweight shelter 50.

Moreover, in order to reduce the dimensions of the section of the profiled elements and therefore their weight and their cost, the spars 531, in particular those of great length, each comprise a means of pre-stressing 61 (see the detail of FIG. 4) making it possible to place each spar 531 in a stretched state, said stretching is opposite that which wail be exerted. by the fabric 54 when the latter will be stretched.

As such, this means of pre-stressing 61 is positioned in the vicinity of the middle of each spar 531 and comprises, more preferably, a cable 611 of which the length is substantially longer than that of said spar 31 and of which the ends are fixed respectively in the vicinity of the ends of said spar 531. The means of pre-stressing 61 further comprise an extendible stressing member 612 extending globally perpendicularly to the spar 531, able to receive the cable 611 and to stretch it, in the manner of a cord of an arc whereon one pulls radially in relation to the sleeve of the arc. This operation will tend to push the middle of the spar 531 back towards the exterior of the frame 53 and make it possible to resist the stretching of the fabric 54 which, on the contrary, has for effect to return said middle of the spar 531 towards the interior of the frame 53.

For this, the stressing member 612 is inclined in such a way as to be substantially parallel to the stretched fabric 54, and comprises a tube 613 integral with the spar 531 and comprising at its free end a threading (not shown), a threaded rod 614 able to be displaced in the tube 613 by cooperating with said threading, a member for receiving 615 in the general shape of a U, fixed to the free end of said threaded. rod 614 and able to receive the cable 611, and a member for blocking 616, advantageously a nut, making it possible to immobilize the threaded rod 614 in relation to tube 613.

Moreover, the frame 53 comprises a system for fastening (not shown) able to provide the fastening of the exterior peripheral edge of the fabric 54 on said frame 53. To do this, the system for fastening is advantageously similar to that described in European patent EP 0 277 073 delivered in the name of the applicant.

As such, the system for fastening is such that each of the spars 531 of the frame 53 has a groove exiting via an inlet slot of a width less than that of the bottom of the groove and that a lock ring can be engaged transversally in the groove, through its inlet slot, and be immobilized therein in order to retain therein the exterior peripheral edge of the fabric 54 having a bead. The system for fastening is remarkable in that in locking position the lock ring is in vertical position, at a right angle in relation to its introduction position via an inlet slot, and it is wedged inside the groove, in such a way that a traction force exerted towards the exterior, on the fabric 54, does not allow the bead of said fabric 54 to escape from the groove.

For more details concerning said system for fastening, reference is made to said European patent EP 0 277 073.

Finally, in reference with FIGS. 10 and 11, in order to facilitate the setting up of the fabric 54 on the frame 53, in particular when the support unit 51 is erected, the fabric 54 has a section 542 joining its interior peripheral edge fixed on the means of connecting 57 to its exterior peripheral edge fixed on said frame 53 and a connecting member 62 able to cooperate with the edges of said section 542 in order to connect them together and form a continuous surface around the support unit 51 by closing the interior and exterior peripheral edges of the fabric 54. This connecting member 62 is a profile of which the length is substantially equal to that of the section 542 and having a section in the general shape of an H of which the free ends 621 are slightly folded back over themselves in such a way as to form two housings 622 able to receive said edges of the section 542 each having a bead 543 (see FIG. 11). In order to set the connecting member 62 in place, one must engage simultaneously, more preferably, one of the ends of the two beads 543 into the housings 622 of said connecting member 62 and slide said connecting member 62 until the other ends of said beads 543 of the fabric 54 in order to obtain a assembled fabric 54 having the aspect shown in FIG. 10.

It is understood that this connecting member 62 is interesting as it makes it possible to put the fabric in place around the support unit 51 after having erected said support unit 51, in order to prevent the fabric 54 from remaining on the ground during the assembly of said support unit 51 and from becoming dirty or even worse deteriorated.

This invention also has for object the method of assembly of said lightweight shelter 50. This assembly takes place in the following manner.

The fabric 54 is placed on the ground in such a way that the solid body that is to receive the central mast 56 of the support unit 51 appears in the on lice of the fabric 54.

Figure 4:
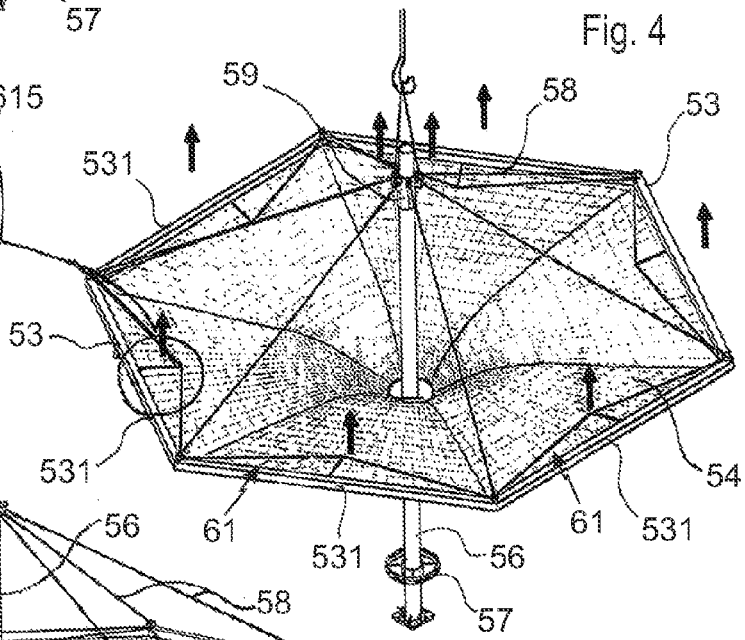

This step can advantageously be carried out after the assembly of the frame 53, as shown in FIGS. 3 and 4, in order to prevent the fabric from becoming dirty or even worse deteriorated. For this, a step of setting up the connecting member 62 must be provided, described previously, on the fabric 54.

The support unit 51 is erected by setting up the central mast 56 on the solid body, beforehand the means of connecting 57 and the flange 59 are assembled slidingly on said central mast 56, the cables 58 being fixed at one of their ends to the flange 59.

Note that for this step of erecting the support unit 51, it is not necessary to have recourse to a crane. The use of a lift mast is also interesting in that its height can be equal, and even less than, that of the support unit 51, in such a way that the lightweight, shelter can be assembled even in locations where the vertical clearance above the lightweight shelter is low.

The following step consists in assembling and in setting up the frame 53 around said support unit 51, as shown in FIG. 3. For this operation, the elements of the frame 53 formed of spars 531 are added. The latter are placed on trestles 63 and the frame 53 is assembled on site by fastening (for example by bolting) the ends of the spars 531 together. Moreover, as the frame 53 is assembled, a means of pre-stressing 61 can be set up on each spar 531 of said frame 53, in particular for the frames 53 of large dimensions.

As shown in FIG. 3, the free end of the cables 58 is then fixed to the fastening points 532 of the frame 53 which are arranged to the right of each top of the frame 53.

The "frame 53-cables 58-flange 59" unit is then slightly raised using a suitable means for hoisting such as a crane of which the hook is connected to said flange 59, in such a way that it is maintained at a height that is sufficient, to allow for an easy setting up of the fabric 54. However, this last intermediate step of hoisting is optional as the following step can be carried out without having to raise the "frame 53-cables 58-flange 59" unit.

After having removed the trestles 63, as shown in FIG. 4, the fabric 54 is fixed in a substantially sealed manner, on the one hand, on the means of connecting 57 by its interior peripheral edge in accordance with what has been described previously and, on the other hand, on the frame 53 by its exterior peripheral edge. The fabric 54 can be fixed on the frame 53 by any known means and particularly gluing, welding, snap-fitting or via a system for fastening similar to that described in European patent EP 0 277 073, as described previously. At this stage, the fabric 54 is not yet stretched.

Figure 5:
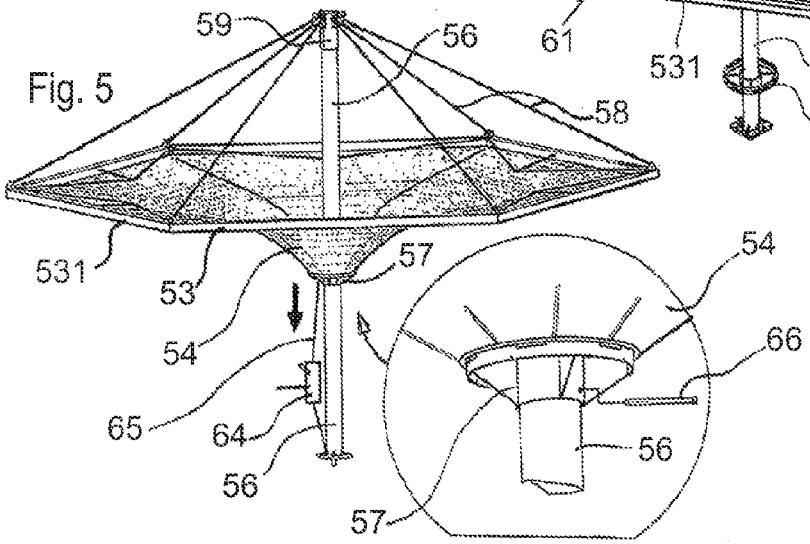

Then, one continues to raise the "frame 53-cables 58-flange 59" unit by pulling the flange 59 upwards until its "locking position." where, as described, above, the mobile elements 605 of the means of quick locking 60 come to press against the-annular face or the upper end of the central mast 56 (see FIGS. 4, 5 and 8).

Then, the fabric 54 must be placed under tension. For this, it is sufficient to pull the means of connecting 57 downwards until the desired stretching of the fabric 54 is obtained. This can be carried out simply, as shown in FIG. 5, by fastening a hand cable-pull 64 for example of the TIRFOR (Registered trademark) type on the lower end of the central mast 56 and by connecting the means of connecting 57 to the cable-pull 64 via a cable 65 (see FIG. 5).

Once the fabric 54 is correctly stretched, the means of connecting 57 are locked in position on the central mast 56 using, for example an axis 66 passing simultaneously through the means of connecting 57 and the central mast 56.

The assembly of the lightweight shelter 50 is now almost complete. The cable-pull 64 can then be removed from the support unit 51 and the rain water collector 55 can be put into place on the central mast 56 around. the means of connecting 57. The lightweight shelter 50 assembled then has the aspect shown in FIG. 2.

It is understood that the previously described. steps may not be executed in the indicated order. For example, the fastening of the fabric 54 can be carried. out before fixing the free end of the cables 58 to the fastening points 532 of the frame 53.

Likewise, it is understood that this assembly can comprise a step of realizing a solid concrete body before erecting the support unit 51.

Further note that this assembly comprises few steps and that it is particularly simple and quick to implement.

Figure 14:
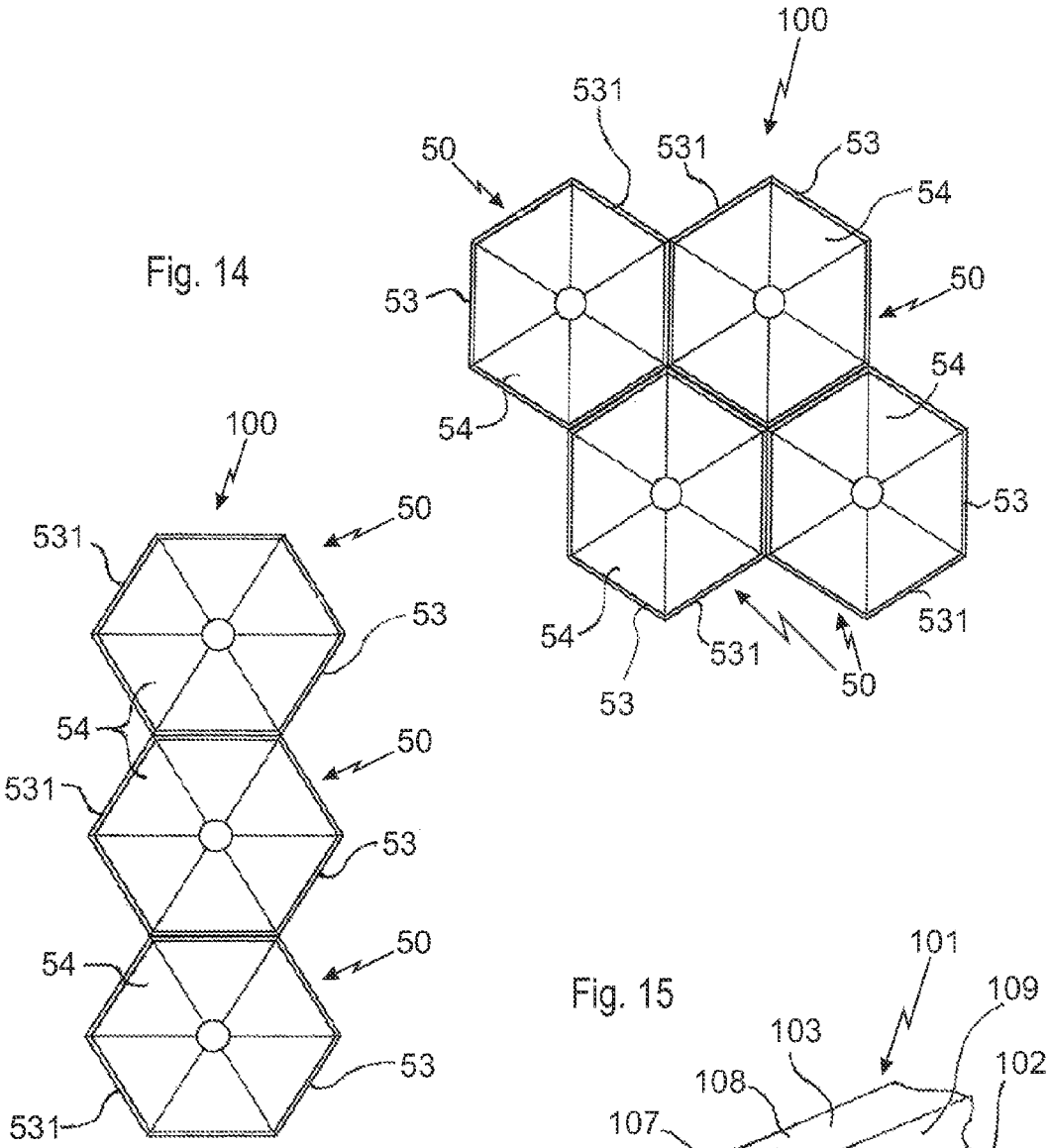
FIG. 14 is a series of top views of different configurations of a modular awning according to the invention.
Figure 15:
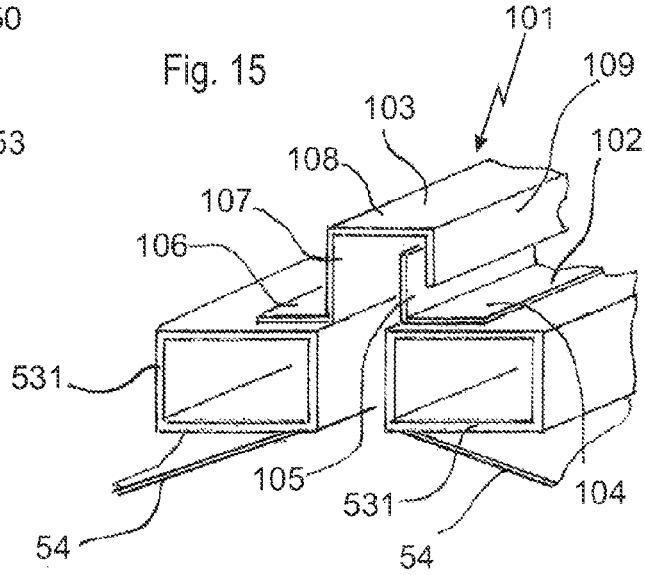
FIG. 15 is a perspective view of a vertical cross-section of the assembly of two lightweight shelters according to the invention constituting a modular awning according to the invention.

In reference to FIGS. 14 and 15, the invention further relates to a modular awning 100 constituted of a plurality of lightweight shelters 50, whether or not of different dimensions, arranged next to one another.

FIG. 14 shows several non-restrictive examples of an arrangement of a modular awning 100 of the invention.

in order to obtain said modular awning 100, as described above, each of the lightweight shelters 50 constituting the modular awning 100 must be assembled and they must be arranged next to one another in such a way that a lightweight shelter 50 comprises at least one spar 531 across from a spar 531 of at least one adjacent lightweight, shelter 50, the spars 531 that are across from each other being near or in contact.

It is understood that in order to obtain a substantially sealed modular awning 100, it is necessary to provide the seal between the various lightweight shelters 50 constituting said modular awning 100.

For this, in reference to FIG. 15, the modular awning 100 comprises a system for sealing 101 between the spars 531 across from the frames 53 of two adjacent lightweight shelters 50.

The system for sealing 101 comprises a first sealing member 102 fixed on the top of one of the two spars 531 across from each other and a second member for sealing 103 fixed on the top of the other spar 531, the first and second sealing members 102, 103 being fixed in a substantially sealed manner on the top of said spars 531 and able to cooperate together in order to create a baffle making it possible to prevent a rain water inlet between the two spars 531 across from each other.

For this, the first sealing member 102 is a corner assembly comprising a first wing 104 in contact with the top of the spar 531 whereon it is fixed and a second wing 105 extending substantially perpendicularly from the top of said spar 531 upwards.

Moreover, the second member for sealing 103 is a profile of which the vertical section has the general shape of a Z comprising a first wing 106 in contact with the top of the spar 531 whereon it is fixed, a second wing 107 extending substantially perpendicularly from the top of said spar 531 upwards and a third wing 108 extending substantially parallel to the top of said spar 531 and provided along its free edge with a return 109 extending substantially perpendicularly from the bottom of said third wing 108 downwards.

When the system for sealing 101 is in place along two spars 531 across from each other, the second wing 107, third wing 108 and return 109 of the second member for sealing 103 partially covers the second wing 105 of the first sealing member 102 in such a way as to create the baffle.

Finally, the invention also has for object the method of assembly of the modular awning 100 according to the invention comprising a plurality of steps, i.e.:

- assembly of the different lightweight shelters 50 constituting the modular awning 100,
- setting up of the system for sealing 101 between the spars 531 across from the frames 53 of two adjacent lightweight shelters 50.

In addition, it is understood that this assembly can comprise, a step of realizing a solid concrete body before assembly the various lightweight shelters 50.

Description of other Embodiments

In an alternative embodiment shown in FIGS. 12 and 13, the lightweight shelter 50 comprises a second. embodiment of the system for fastening able to provide the fastening of the exterior peripheral edge of the fabric 54 on said frame 53. As such, this system for fastening comprises a string 67, advantageously elastic, passing alternatively around spars 531 of the frame 53 and in the orifices arranged along said exterior peripheral edge of the fabric 54. This system for fastening makes it possible to fix the fabric 54 on the frame 53 but also to partially or fully provide the stretching of the fabric 54.

In another alternative embodiment not shown, in the "locking position" the mobile elements 605 of the means of quick locking 60 do not come to press against the annular face of the upper end of the central mast 56 but each cooperate with an orifice made in the upper end of said central mast 56. However, this configuration is not very advantageous because it requires an angular positioning of the flange 59 during its assembly.

Said mobile elements 605 can also cooperate with a perimetric groove made at the upper end of said central mast 56 without leaving the scope of this invention.

In another alternative embodiment not shown, the frame 53 of the roof element 52 of the lightweight shelter 50 does not have a hexagon shape but has a shape of an advantageously regular polygon comprising 8, 10, 12 or 14 tops.

Said frame 53 can also have a polygon shape with an odd number of tops and at least equal to 5, without leaving the scope of this invention. However, in this configuration, the cables 58 will not be arranged. symmetrically two-by-two in relation to the axis of the central mast 56 of the support unit 51.

Said frame 53 can also have the shape of a polygon with a substantial number of tops in such a way as to tend towards a circular shape without leaving the scope of this invention.

However, these different configurations increase the number of parts (spars and cables) and consequently the assembly time. Furthermore, configurations of frames 53 with a high number of tops do not make it possible to juxtapose lightweight shelters 50 in order to form a modular awning 100. The hexagonal shape remains the good compromise between mechanical resistance, assembly time and juxtaposability.

Finally, the system for sealing 101 between the spars 531 across from the frames 53 of two adjacent lightweight shelters 50 can be a simple profile in the shape of a U (not shown) without leaving the scope of this invention. This U-shaped profile will have a core resting on the top of the two spars 531 across from each other and of which the width will be greater than that of said spars 531, and two wings slightly expanded oriented downwards. This U-shaped profile will, cap the two spars 531 and will prohibit the entry of rain water between the two spars 531 across from each other.

In another alternative embodiment not shown, the support unit, similar to the support unit 51 described previously, comprises a telescopic central mast. Indeed, for reasons of transport, in particular for an export of said element support in an ocean container, it is interesting that this central mast be telescopic. To do this, said central mast is formed of at least two mobile elements in longitudinal translation one in relation to the other. Advantageously, the central mast comprises only two elements, the first element referred to as "lower" being a hollow tube intended to be fixed. on a solid body by suitable means of fastening, the second element referred to as "upper" being a hollow tube able to slide inside said lower element.

Once fully stretched, the central mast is locked in position using, for example, an axis simultaneously passing through said two elements. Once the central mast is locked, the flange can be assembled slidingly on said central mast as well as all of the elements that comprise the support unit according to the method described previously.

Finally, in a last alternative embodiment not shown, the support unit, similar to the support unit 51 described previously, further comprises a telescopic central mast comprising a lower element, and at least one upper element sliding inside said lower element which is fixed on a solid body. This support unit further comprises a flange fixed at the upper end of the upper element. As such, the sliding assembly of the flange on the central mast is carried out by the sliding of the unit (flange-upper element) inside said lower element.

It is understood that if the central mast comprises more than two mobile elements, the flange will be fixed on the upper element which is that which is arranged the highest of the central mast when the latter is fully stretched.

Possibility of Industrial Application

The support element 51 of a roof element 52 according to the invention and the lightweight shelter 50 comprising such a support element 51 can advantageously be installed on any type of site regardless of the climatic and access conditions. Furthermore, the description clearly shows that the structure of the lightweight shelter 50 according to the invention is of a light, simple and quick construction, while still guaranteeing remarkable mechanical resistance.

Finally, it is understood that the examples of support element 51 of a roof element 52 and of lightweight shelter 50 in accordance with the invention which have just been described are only particular illustrations, and in case restrictive of the invention.

The invention claimed is:

1. A support unit of a roof element comprising:

a central mast, means of connecting adapted to receive a central portion of a fabric of the roof element, the fabric being fixed by its exterior peripheral edge on a frame of the roof element, a flange assembled slidingly on said central mast, the flange being slidable between a sliding position and a locking position, the sliding position being further from an upper end of the central mast than the locking position, and the flange being arranged in order to be locked relative to the central mast by means of quick locking of the snap-fitting type when in the locking position, and a plurality of cables having ends, one of the ends of each of the plurality of cables is fixed on said flange, another one of the ends of each of the plurality of cables being intended to be fixed on the frame of the roof element, said means of connecting being assembled slidingly on said central mast and arranged in order to be locked on said central mast, the flange and the means of connecting being adapted to tension the fabric when the flange is locked in the locking position and the means of connecting is locked on the central mast, the locking position being disposed above the frame of the roof element when the fabric is in tension, the means of connecting being disposed below the frame of the roof element when the fabric is in tension and the means of connecting is locked on the central mast.

2. The support unit according to claim 1, wherein the means of connecting comprise a sleeve allowing for the sliding of the means of connecting along the central mast, a segment provided at its upper end with a stop extending radially towards the exterior, means of connecting connecting the sleeve to the segment and a locking ring.

3. The support unit according to claim 1, wherein the means of quick locking include at least one radial orifice located on the flange, at least one tubular housing integral with the flange and extending radially towards the exterior of the flange to the right of the orifice, a stop located at the free end of said housing, a thrust member contained in the housing and pressing against the stop, and a mobile element passing partially through the orifice and arranged in order to be displaced in the housing under the action of the thrust member from a sliding position to a locking position.

4. The support unit according to claim 3, wherein in the locking position the mobile element comes to press against the annular face of the upper end of the central mast.

5. The support unit according to claim 4, wherein the means of quick locking comprise three orifices arranged in the same radial plane on the flange and of which the axes form an angle of 120 degrees between them, and three housing-stop-thrust member-mobile element units.

6. The support unit according to claim 3, wherein the means of quick locking comprise three orifices arranged in the same radial plane on the flange and of which the axes form an angle of 120 degrees between them, and three housing-stop-thrust member-mobile element units.

7. The support unit according to claim 1, wherein the central mast is a mast formed from at least two mobile elements in longitudinal translation in relation to one another.

8. The support unit according to claim 7, wherein the central mast comprises a lower element fixed on a solid body and at least one upper element sliding inside said lower element.

9. The support unit according to claim 8, wherein the flange is fixed on the upper element.

10. A lightweight shelter comprising:

a support unit including:

a central mast, means of connecting assembled slidingly on said central mast and arranged in order to be locked on said central mast, a flange assembled slidingly on said central mast, the flange being slidable between a sliding position and a locking position, the sliding position being further from an upper end of the central mast than the locking position, and the flange arranged in order to be locked relative to the central mast by means of quick locking of the snap-fitting type when in the locking position, and a plurality of cables having ends, one of the ends of each of the plurality of cables is fixed on said flange, and a roof element including a frame and a fabric, the frame arranged around the central mast of said support unit, the frame having a shape of a regular polygon, and being suspended by the plurality of cables of the support unit connected solely to fastening points of the frame arranged to a right of each top of the frame, the fabric being provided in its central portion with an orifice of which an edge defines an interior peripheral edge of said fabric, the fabric being fixed by its exterior peripheral edge on the frame and by its interior peripheral edge on the means of connecting of the support unit, the fabric being stretched between said frame and the support unit when the flange is locked in the locking position and the means of connecting is locked on the central mast, the locking position being disposed above the frame of the roof element when the fabric is stretched, the means of connecting being disposed below the frame of the roof element when the fabric is stretched and the means of connecting is locked on the central mast.

11. The lightweight shelter according to claim 10, wherein the frame is constituted of spars assembled to one another by their ends and in the shape of a regular polygon comprising an even number of tops, at least equal to six.

12. The lightweight shelter according to claim 11, wherein the spars each comprise a means of pre-stressing.

13. The lightweight shelter according to claim 12, wherein the means of pre-stressing is positioned in the vicinity of the middle of each spar and comprises a cable and an extendable stressing member and able to receive the cable.

14. The lightweight shelter according to claim 13, wherein the stressing member extends globally perpendicularly to the spar and is inclined in such a way as to be substantially parallel to the fabric of said lightweight shelter.

15. The lightweight shelter according to claim 14, wherein the stressing member comprises a tube integral with the spar and comprising at its free end a threading, a threaded rod able to be displaced in the tube by cooperating with said threading, a member for receiving in the general shape of a U, fixed to the free end of said threaded rod and able to receive the cable, and a member for blocking making it possible to immobilize the threaded rod in relation to tube.

16. The lightweight shelter according to claim 10, wherein the fabric comprises along its interior peripheral edge a ring, this ring being formed by a ring taken in a fold of said fabric.

17. The lightweight shelter according to claim 16, wherein the ring is blocked, in the position where the fabric is assembled, via the interposing of the locking ring of the means of connecting of the support unit between said ring and the stop of the segment of said means of connecting.

18. The lightweight shelter according to claim 10, wherein the fabric comprises a section joining its interior peripheral edge to its exterior peripheral edge fixed and defining two edges each having a bead.

19. The lightweight shelter according to claim 18, wherein the fabric comprises a connecting member able to cooperate with the beads in order to connect them together and form a continuous surface around the support unit by closing the interior and exterior peripheral edges of said fabric.

20. The lightweight shelter according to claim 19, wherein the connecting member is a profile of which the length is substantially equal to that of the section of the fabric and having a section in the general shape of an H of which the free ends are folded back slightly on themselves in such a way as to form two housings able to receive said beads.

21. The lightweight shelter according to claim 10, further comprising a rain water collector the central mast around the means of connecting.

22. A modular awning comprising a plurality of lightweight shelters according to claim 10, arranged next to each other and a system for sealing between the spars across from the frames of two adjacent lightweight shelters.

23. The modular awning according to claim 22, wherein the system for sealing comprises a first sealing member fixed on the top of one of the two spars across from each other and a second member for sealing fixed on the top of the other spar, the first and second sealing members being fixed in a substantially sealed manner on the top of said spars and able to cooperate together in order to create a baffle.

* * * * *

UNITED STATES PATENT AND TRADEMARK OFFICE

CERTIFICATE OF CORRECTION

PATENT NO. : 8,807,153 B2
APPLICATION NO. : 13/072310
DATED : August 19, 2014
INVENTOR(S) : Dalo It is certified that error appears in the above-identified patent and that said Letters Patent is hereby corrected as shown below:

In the Claims

Claim 10, column 11, line 41, “the flange arranged” should read -- the flange being arranged --.

Signed and Sealed this
Third Day of February, 2015

Michelle K. Lee

Michelle K. Lee
*Deputy Director of the United States Patent and Trademark Office*